US008373606B2

(12) United States Patent
Wong et al.

(10) Patent No.: US 8,373,606 B2
(45) Date of Patent: Feb. 12, 2013

(54) SLIM MOBILE COMMUNICATION DEVICE AND ANTENNA STRUCTURE THEREOF

(75) Inventors: Kin-Lu Wong, Tapei Hsien (TW); Wei-Yu Chen, Tapei Hsien (TW)

(73) Assignee: Acer Inc., Taipei Hsien (TW)

( * ) Notice: Subject to any disclaimer, the term of this patent is extended or adjusted under 35 U.S.C. 154(b) by 455 days.

(21) Appl. No.: 12/789,903

(22) Filed: May 28, 2010

(65) Prior Publication Data

US 2011/0215972 A1 Sep. 8, 2011

(30) Foreign Application Priority Data

Mar. 5, 2010 (TW) ..... 99106538 A

(51) Int. Cl.
*H01Q 1/24* (2006.01)

(52) U.S. Cl. ..... 343/702; 343/700 MS; 343/846

(58) Field of Classification Search ..... 343/700 MS, 343/702, 829, 846
See application file for complete search history.

(56) References Cited

U.S. PATENT DOCUMENTS

| | | | | |
|---|---|---|---|---|
| 4,040,060 | A * | 8/1977 | Kaloi | 343/700 MS |
| 5,173,711 | A * | 12/1992 | Takeuchi et al. | 343/700 MS |
| 6,111,544 | A * | 8/2000 | Dakeya et al. | 343/700 MS |
| 6,369,771 | B1 * | 4/2002 | Chiang et al. | 343/795 |
| 7,098,852 | B2 * | 8/2006 | Ikuta et al. | 343/700 MS |
| 7,649,501 | B2 * | 1/2010 | Wong et al. | 343/702 |

* cited by examiner

*Primary Examiner* — Tho G Phan
(74) *Attorney, Agent, or Firm* — Alan Kamrath; Kamrath IP Lawfirm, P.A.

(57) ABSTRACT

A slim mobile communication device includes an antenna structure. The antenna structure includes a dielectric substrate, a ground element, an antenna element, and a feeding line. The antenna element is a planar structure and is disposed on a no-ground portion of the dielectric substrate. At least two edges of the no-ground portion are surrounded by a ground element of the dielectric substrate, wherein one of the edges used as a feeding edge and the other edges are non-feeding edges. A distance between the non-feeding side edge of the antenna element and the second edge of the no-ground portion is smaller than 3 mm. A length of the non-feeding side edge of the antenna element is at least 5 mm. The non-feeding side edge of the antenna element is short-circuited to the ground element. The feeding line is coupled to the feeding side edge of the antenna element.

15 Claims, 4 Drawing Sheets

SLIM MOBILE COMMUNICATION DEVICE AND ANTENNA STRUCTURE THEREOF

BACKGROUND OF THE INVENTION

1. Field of the Invention

The present invention relates to a slim mobile communication device and a related antenna structure and, more particularly, to a slim mobile communication device and a related antenna structure having a wireless wide area network (WWAN) antenna that is tightly coupled to a neighboring system ground plane.

2. Description of the Related Art

With developments in mobile communication devices, a built-in antenna of a mobile communication device is not only required to satisfy the operating bands of the wireless wide area network (at least 824~960 MHz and 1710~2170 MHz), but also required to have close integration between the built-in antenna and a system ground plane in order to make effective use of the interior space of the mobile communication device. Therefore, the built-in antenna of the mobile communication device must be designed not only to be light and slim, but also to be tightly coupled to the system ground plane. Furthermore, in order to have wideband operating capabilities, the antenna is usually disposed at a no-ground portion to have a lower Q value and is able to cover five operating bands of WWAN (i.e., 824~960 MHz and 1710~2170 MHz). Then the antenna can form a planar structure on the no-ground portion to decrease the height of the antenna disposed on the system circuit board and be applied to a slim mobile communication device.

However, a side edge of the antenna designed by the method above, especially a side edge comprising the end terminal of the antenna, must have a clearance distance to the ground plane to decrease the effects on the performances of the antenna. As a result, the antenna needs a larger no-ground portion, and the size of the ground portion of the mobile communication device will hence be decreased. Therefore, the arrangement of the associated electronic components to be disposed on the ground portion of the mobile communication device will be affected.

A planar antenna in the prior art, disclosed in U.S. public US 2009/0273521 A1 "Coplanar Coupled-fed multiband antenna for the mobile device," is applied for WWAN operation and is disposed on a no-ground portion. However, the no-ground portion in the prior art is separated from the system ground plane by a linear or straight edge and cannot be tightly coupled to the system ground plane. In order to be tightly coupled to the system ground plane, at least two edges of the no-ground portion should be surrounded by the neighboring system ground plane. Therefore, although the antenna is capable of wideband operation, the antenna needs a larger no-ground portion, and the arrangement of the interior space of the mobile communication device will be affected.

Therefore, it is desirable to provide a slim mobile communication device to mitigate and/or obviate the aforementioned problems.

SUMMARY OF THE INVENTION

A main object of the present invention is to provide a slim mobile communication device having a WWAN antenna with five operating bands (including at least 824~960 MHz and 1710~2170 MHz), the antenna being capable of tightly coupled to the system ground plane of the dielectric substrate and achieving effective use of the interior space of the mobile communication device.

Another main object of the present invention is to provide an antenna structure having a WWAN antenna with five operating bands (including at least 824~960 MHz and 1710~2170 MHz), the antenna being capable of tightly coupled to the system ground plane of the dielectric substrate and achieving effective use of the interior space of the mobile communication device.

In order to achieve that main objective, the slim mobile communication device of the present invention includes an antenna structure, wherein the antenna structure includes a dielectric substrate, a ground element, an antenna element, and a feeding line. The dielectric substrate includes a no-ground portion and a ground portion. The no-ground portion includes a first edge used as a feeding edge and a second edge used as a non-feeding edge. The ground element is disposed on the ground portion of the dielectric substrate. The antenna element is a planar structure providing a first operating band and a second operating band. The antenna element is disposed on the no-ground portion of the dielectric substrate. The first edge and the second edge of the no-ground portion are surrounded by the ground element, wherein a distance between the non-feeding side edge of the antenna element and the second edge of the no-ground portion is smaller than 3 mm. A length of the non-feeding side edge of the antenna element is at least 5 mm. The non-feeding side edge of the antenna element is short-circuited to the ground element. The feeding line is coupled to the feeding side edge of the antenna element.

According to one of embodiment of the present invention, the dielectric substrate can be a system circuit board of a mobile phone, and the antenna element is printed or etched on the dielectric substrate.

In order to achieve that another objective, the antenna structure includes a dielectric substrate, a ground element, an antenna element, and a feeding line. The dielectric substrate includes a no-ground portion and a grounded portion, wherein the no-ground portion includes a first edge used as a feeding edge and a second edge used as a non-feeding edge. The ground element is disposed on the ground portion of the dielectric substrate. The antenna element provides a first operating band and a second operating band, and is disposed on the no-ground portion of the dielectric substrate; wherein the first edge and the second edge of the no-ground portion are surrounded by the ground element; and a non-feeding side edge of the antenna element is short-circuited to the ground element. The feeding line is coupled to the feeding side edge of the antenna element.

Other objects, advantages, and novel features of the invention will become more apparent from the following detailed description when taken in conjunction with the accompanying drawings.

DETAILED DESCRIPTION OF THE PREFERRED EMBODIMENT

The advantages and innovative features of the invention will become more apparent from the following descriptions of the preferred embodiments.

Figure 1:
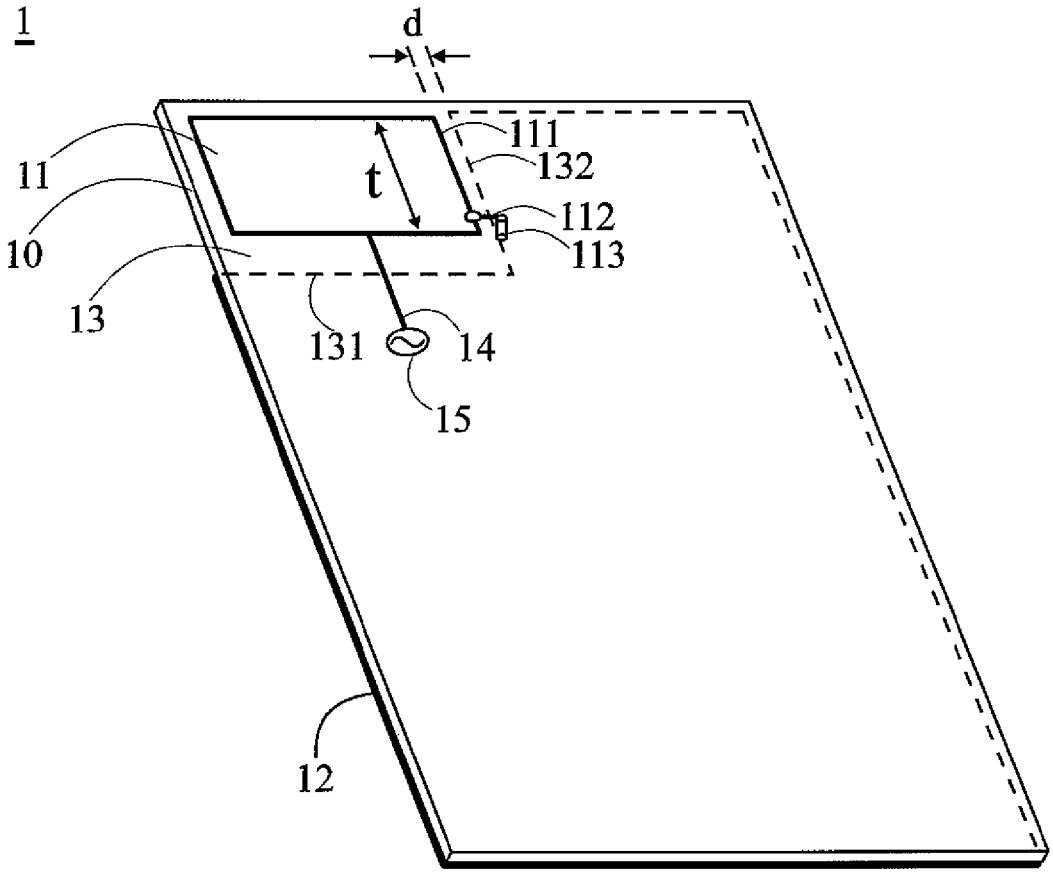
FIG. 1 is a perspective drawing of a slim mobile communication device and its antenna structure according to a first embodiment of the present invention.
Figure 2:
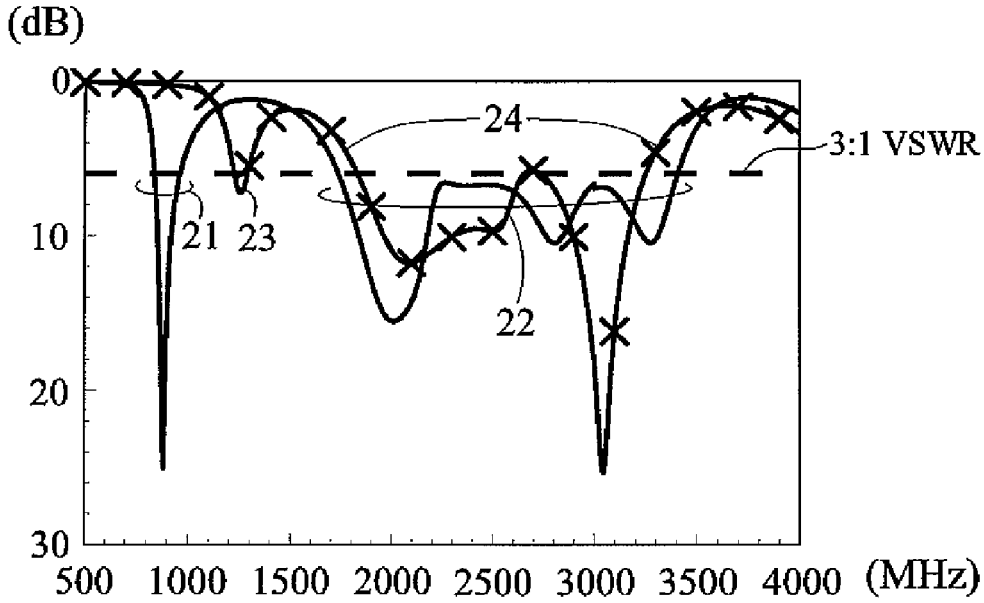
FIG. 2 shows a return loss simulation result according to the first embodiment of the present invention and a return loss simulation result according to the antenna without short-circuiting to the ground element.

FIG. 1 is a perspective drawing of a slim mobile communication device and its antenna structure according to a first embodiment of the present invention. The slim mobile communication device 1 includes an antenna structure, and the antenna structure includes a dielectric substrate 10, a ground element 12, an antenna element 11, and a feeding line 14. The dielectric substrate 10 can be a system circuit board of a mobile phone. The antenna element 11 may be printed or etched on the dielectric substrate 10 and forms a planar structure, but this is not meant to be limitations of the present invention. As shown in FIG. 2, the antenna element 11 provides a first operating band 21 and a second operating band 22.

In this embodiment, the dielectric substrate 10 includes a first surface and a second surface being opposite to the first surface. The ground element 12 is disposed on the first surface of the dielectric substrate 10, and the antenna element 11 is disposed on the second surface of the dielectric substrate 10.

The antenna element 11 is disposed on a no-ground portion 13 of the dielectric substrate 10. The no-ground portion 13 includes a first edge (a feeding edge 131) and a second edge (a non-feeding edge 132), and the first edge and the second edge are surrounded by the ground element 12 of the dielectric substrate 10. The first edge and the second edge of the no-ground portion 13 are substantially perpendicular to each other. In other words, the first edge is the feeding edge 131 and is passed through by the feeding line 14, which is connected to the signal source 15. The second edge is a non-feeding edge 132. The distance d between a side edge 111 (also called as the non-feeding side edge) of the antenna element 11 and the second edge (i.e., a non-feeding edge 132) of the no-ground portion 13 is less than 3 mm, and the length t of the side edge 111 of the antenna element 11 is at least 5 mm. The side edge 111 of the antenna element 11 is the side edge comprising the end terminal of the antenna element 11.

Furthermore, the side edge 111 is electrically connected to the ground element 12 via a through hole 113 by a short-circuiting line 112 of the antenna element 11. The ground element 12 can be a system ground element of a mobile phone.

FIG. 2 shows a return loss simulation result according to the first embodiment of the present invention, wherein the horizontal axis indicates the operating frequency and the vertical axis indicates the return loss. The first embodiment is simulated in the following dimensions: the length of the dielectric substrate 10 is about 115 mm, the width is about 50 mm, and the thickness is about 0.8 mm. The length of the no-ground portion 13 is about 15 mm, and the width is about 25 mm. The other portion of the dielectric substrate 10 is the ground element 12. As shown in FIG. 2, in the first embodiment, the first operating band 21 of the antenna element 11 covers at least 824~960 MHz, and the second operating band 22 covers at least 1710~2170 MHz, based on the definition of the 3:1 VSWR return loss (the design specification of the mobile communication device antenna). These two operating bands mentioned above are capable of covering five operating bands of WWAN, comprising the two operating bands of GSM850/900 (824~960 MHz) and the three operating bands of GSM1800/1900/UMTS (1710~2170 MHz).

In addition, under a condition that the non-feeding side edge 111 of the antenna element 11 is not electrically connected to the ground element 12 and the antenna element 11 is not short-circuited to the ground element 12, the equivalent inductance cannot be provided to compensate for the variations in the input impedance matching of the antenna element 11 surrounded by the ground element 12. Although the antenna element 11 is capable of generating a third operating band 23 and a fourth operating band 24, as shown in FIG. 2, these two operating bands can not completely cover all five operating bands of the WWAN.

Figure 3:
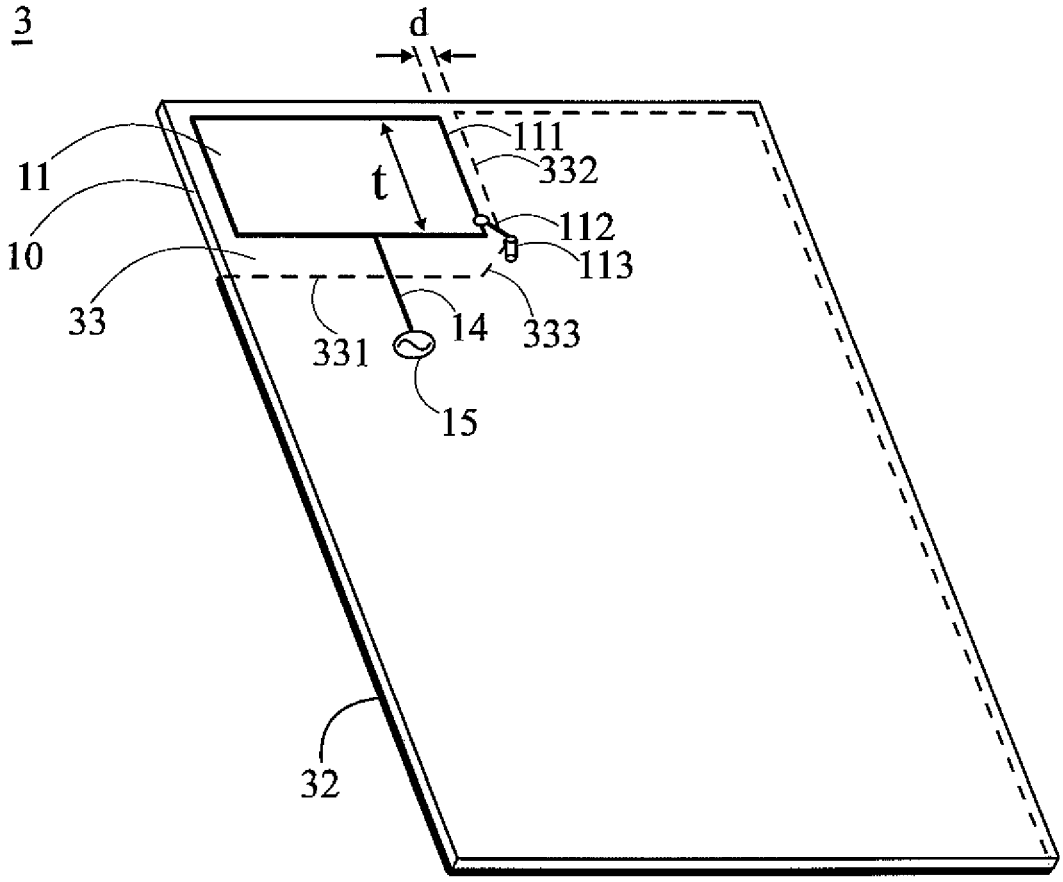
FIG. 3 is a perspective drawing of a slim mobile communication device and its antenna structure according to a second embodiment of the present invention.

FIG. 3 is a perspective drawing of a slim mobile communication device and its antenna structure according to a second embodiment of the present invention. The slim mobile communication device 3 includes an antenna structure, and the antenna structure includes a dielectric substrate 10, a ground element 32, an antenna element 11, and a feeding line 14. Unlike the structure of the first embodiment, the no-ground portion 33 of the second embodiment includes three edges: a first edge (i.e., a feeding edge 331), a second edge (i.e., a non-feeding edge 332), and a third edge (i.e., a non-feeding edge 333), wherein the non-feeding edge 333 is disposed between the feeding edge 331 and the non-feeding edge 332. The feeding edge 331 and the non-feeding edges 332, 333 are surround by the ground element 32 of the dielectric substrate 10. Although the shape of the no-ground portion 33 in the second embodiment mentioned above differs from the no-ground portion 13 in the first embodiment, the equivalent capacitance and the inductance generated by the antenna element 11 in the second embodiment can be adjusted by adjusting the length of the side edge 111 and the position of the short-circuiting line 112 in order to achieve the same effect as the first embodiment.

Figure 4:
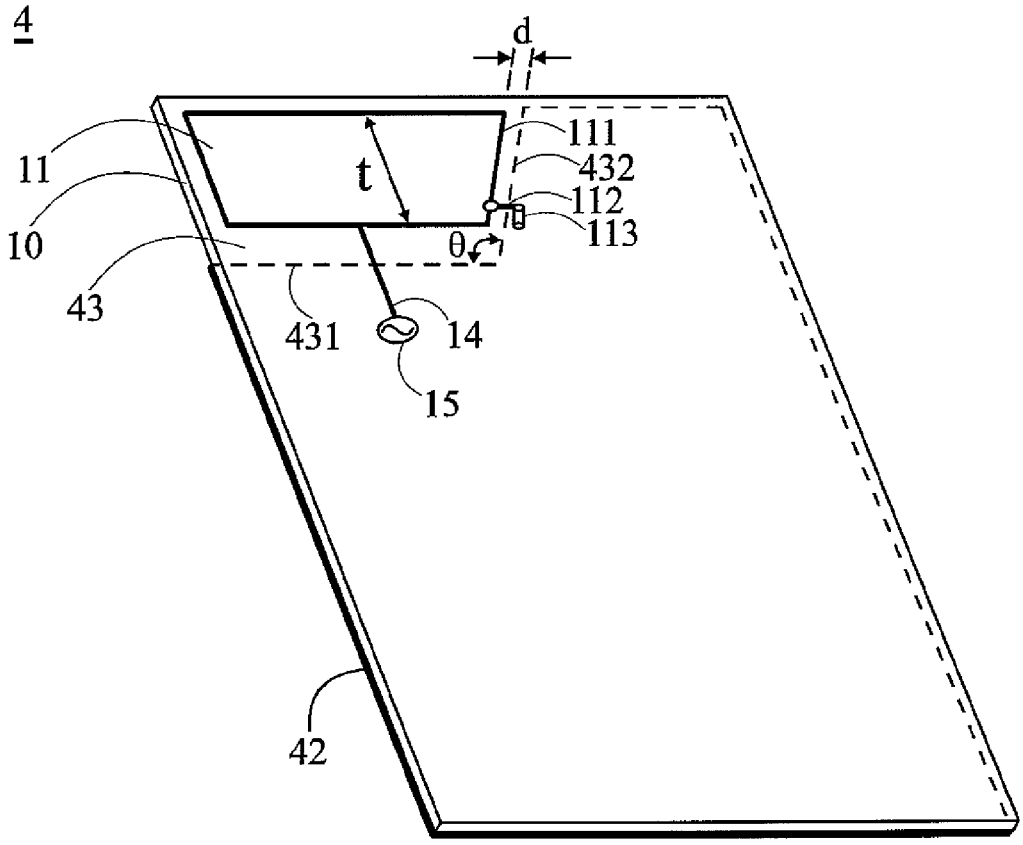
FIG. 4 is a perspective drawing of a slim mobile communication device and its antenna structure according to a third embodiment of the present invention.

FIG. 4 is a perspective drawing of a slim mobile communication device and its antenna structure according to a third embodiment of the present invention. The slim mobile communication device 4 includes an antenna structure, wherein the antenna structure includes a dielectric substrate 10, a ground element 42, an antenna element 41, and a feeding line 14. In the third embodiment, only two edges of the no-ground portion 43 are surrounded by the ground element 42, wherein the two edges are the first edge (i.e., a feeding edge 431) and the second edge (i.e., a non-feeding edge 432). Please note that there is an angle θ existed in between the feeding edge 431 and the non-feeding edge 432, wherein the angle θ is between 80 degrees and 135 degrees. Although the shape of the no-ground portion 43 in the third embodiment differs from the no-ground portion 13 in the first embodiment, the equivalent capacitance and the inductance generated by the antenna element 41 in the third embodiment can be adjusted by adjusting the length of the side edge 111 and the position of the short-circuiting line 112 to achieve the same effect as the first embodiment.

As a result, a capacitive coupling and an equivalent capacitance can be generated between the side edge 111 of the antenna element 11 and the ground element, and an equivalent inductance can be provided by the side edge of the antenna element short-circuited to the ground element. Therefore, the edge coupling effect generated by the antenna tightly coupled to the surrounding ground element can be compensated for. In the present invention, the equivalent capacitance and the equivalent inductance are used for adjusting and compensating for the antenna input impedance matching being affected by the edge coupling. That is to say, the antenna element, which is tightly coupled to the system ground element, can generate good input impedance matching and has good radiation characteristics.

Although the present invention has been explained in relation to its preferred embodiment, it is to be understood that many other possible modifications and variations can be made without departing from the spirit and scope of the invention as hereinafter claimed.

What is claimed is:

1. A slim mobile communication device, comprising an antenna structure, the antenna structure comprising:

a dielectric substrate, comprising a no-ground portion and a ground portion, wherein the no-ground portion comprises a first edge used as a feeding edge and a second edge used as a non-feeding edge;

a ground element, disposed on the ground portion of the dielectric substrate;

an antenna element, that is a planar structure providing a first operating band and a second operating band, and is disposed on the no-ground portion of the dielectric substrate; the first edge and the second edge of the no-ground portion are surrounded by the ground element; wherein a distance between a non-feeding side edge of the antenna element and the second edge of the no-ground portion is smaller than 3 mm, a length of the non-feeding side edge of the antenna element is at least 5 mm, and the non-feeding side edge of the antenna element is short-circuited to the ground element; and a feeding line, coupled to the feeding side edge of the antenna element.

2. The slim mobile communication device as claimed in claim 1, wherein the first edge and the second edge of the no-ground portion are substantially perpendicular to each other.

3. The slim mobile communication device as claimed in claim 1, wherein there is an angle existed in between the first edge and the second edge of the no-ground portion, and the angle is between 80 degrees and 135 degrees.

4. The slim mobile communication device as claimed in claim 1, wherein the no-ground portion further comprises a third edge, and the third edge is disposed between the first edge and the second edge.

5. The slim mobile communication device as claimed in claim 1, wherein the dielectric substrate comprises a first surface and a second surface being opposite to the first surface; and the ground element is disposed on the first surface of the dielectric substrate, and the antenna element is disposed on the second surface of the dielectric substrate.

6. The slim mobile communication device as claimed in claim 1, wherein the dielectric substrate is a system circuit board of a mobile phone.

7. The slim mobile communication device as claimed in claim 1, wherein the ground element is a system ground plane of a mobile phone.

8. The slim mobile communication device as claimed in claim 1, wherein the first operating band of the antenna element covers at least 824 to 960 MHz.

9. The slim mobile communication device as claimed in claim 1, wherein the second operating band of the antenna element covers at least 1710 to 2170 MHz.

10. An antenna structure, comprising:

a dielectric substrate, comprising a no-ground portion and a ground portion, wherein the no-ground portion comprises a first edge used as a feeding edge and a second edge used as a non-feeding edge;

a ground element, disposed on the ground portion of the dielectric substrate;

an antenna element, providing a first operating band and a second operating band, and is disposed on the no-ground portion of the dielectric substrate; wherein the first edge and the second edge of the no-ground portion are surrounded by the ground element; and a non-feeding side edge of the antenna element is short-circuited to the ground element; and a feeding line, coupled to the feeding side edge of the antenna element.

11. The antenna structure as claimed in claim 10, wherein a distance between the non-feeding side edge of the antenna element and the second edge of the no-ground portion is smaller than 3 mm, and a length of the non-feeding side edge of the antenna element is at least 5 mm.

12. The antenna structure as claimed in claim 10, wherein the first edge and the second edge of the no-ground portion are substantially perpendicular to each other.

13. The antenna structure as claimed in claim 10, wherein there is an angle existed in between the first edge and the second edge of the no-ground portion, and the angle is between 80 degrees and 135 degrees.

14. The antenna structure as claimed in claim 10, wherein the no-ground portion further comprises a third edge, and the third edge is disposed between the first edge and the second edge.

15. The antenna structure as claimed in claim 10, wherein the dielectric substrate comprises a first surface and a second surface being opposite to the first surface; and the ground element is disposed on the first surface of the dielectric substrate, and the antenna element is disposed on the second surface of the dielectric substrate.

* * * * *